US006494004B1

(12) United States Patent
Zimmerman

(10) Patent No.: US 6,494,004 B1
(45) Date of Patent: Dec. 17, 2002

(54) SELF JIGGING CONCRETE WALL STRUCTURE AND METHOD OF CONSTRUCTION

(75) Inventor: Melvin M. Zimmerman, Denver, PA (US)

(73) Assignee: SWA Holding Company, Inc., New Holland, PA (US)

( * ) Notice: Subject to any disclaimer, the term of this patent is extended or adjusted under 35 U.S.C. 154(b) by 0 days.

(21) Appl. No.: 09/845,063

(22) Filed: Apr. 30, 2001

(51) Int. Cl.[7] ..... E04B 1/14; E04B 1/16

(52) U.S. Cl. ..... 52/251; 52/259; 52/309.12; 52/405.3; 264/135; 264/154; 264/229; 249/26; 249/28; 249/35

(58) Field of Search ..... 52/250, 251, 258, 52/281, 405.1, 405.3, 259, 414; 249/26, 28, 29, 31, 33, 160, 170–172; 264/135, 154, 229, 263, 275, 276, 277, 333

(56) References Cited

U.S. PATENT DOCUMENTS 3,638,902 A * 2/1972 Bergan ..... 249/28
4,570,398 A 2/1986 Zimmerman
4,751,803 A 6/1988 Zimmerman
4,934,121 A 6/1990 Zimmerman
4,942,707 A * 7/1990 Huettemann ..... 52/259
5,055,252 A 10/1991 Zimmerman
5,381,635 A * 1/1995 Sanger ..... 52/251
5,656,194 A 8/1997 Zimmerman
5,865,001 A 2/1999 Martin et al.
5,956,911 A * 9/1999 Kistner et al. ..... 52/302.3
6,003,278 A 12/1999 Weaver et al.
6,280,669 B2 * 8/2001 Kistner et al. ..... 264/135

* cited by examiner

*Primary Examiner*—Yvonne M. Horton
(74) *Attorney, Agent, or Firm*—Martin Fruitman

(57) ABSTRACT

The disclosure is for a method and apparatus for constructing a concrete wall with a single pouring of concrete. The mold for the pouring of the wall is formed essentially of plastic foam insulation which remains attached to the finished wall to serve as thermal insulation. The wall structure is therefore self jigging and requires no elaborate mold structure or any time or labor to remove the finished wall from the mold.

19 Claims, 3 Drawing Sheets

SELF JIGGING CONCRETE WALL STRUCTURE AND METHOD OF CONSTRUCTION

BACKGROUND OF THE INVENTION

This invention deals generally with building construction and more specifically with the construction of concrete prefabricated walls.

The traditional methods of constructing building basements are well established. For commercial structures and for high volume residential developments with identical dimensions for each building, poured concrete is used. This involves the construction of forms, either wood or metal, in the exact shape of the vertical basement walls, and then pouring concrete into the forms. After the concrete hardens, the forms are removed and construction continues on the rest of the building.

The cost of forms limits this method to structures where the height requires the strength of reinforced concrete or where the reuse of forms for many identical structures in the same general area permits sharing of the costs of form construction by many buildings.

The more common basement construction technique for individual residential houses is the straight forward construction of the vertical walls by laying many courses of cinder block, one on top of the other. This method is the traditional one used for isolated building sites and small developments, and it is both time consuming and labor intensive. It requires each cinder block to be individually placed and surrounded with mortar. One need only watch a traditional house being built to realize that the cinder block basement may take over a week to construct on a typical site, while the framing and exterior walls go up in just a day or so. Above ground walls of wood and sheathing have been prefabricated for over fifty years, but prefabrication of concrete walls has only started recently.

U.S. Pat. No. 4,605,529, issued Aug. 12, 1986 to Melvin M. Zimmerman, the present inventor, discloses a prefabricated concrete wall structure and the method and assembly jig for the wall's construction. The method disclosed permits construction of a wall which is no longer linked to the amount of manpower available at the construction site, because the labor at the construction site involves only installation of the previously manufactured wall. Moreover, the cost of the wall is relatively unrelated to the size of the wall.

However, the cost of such a prefabricated wall is greatly influenced by the ease of its off-site manufacture, and to facilitate construction the wall is constructed within a horizontal assembly jig, so that conventional concrete delivery trucks can be used as a source of material.

The assembly jig of the prior art is essentially a set of channel members oriented in a horizontal plane. The channels are arranged in parallel, about eight feet apart, and the channels include precut notches on their innermost walls. These notches are used to support previously manufactured concrete studs which are set in the horizontal plane perpendicular to the parallel channels. A typical spacing for the notches is two feet center to center.

The channel members and frame sides joining the ends of the channel members are constructed so that the peripheral edges of the grid formed by the studs and the channels, that is, the edges forming an outside rectangle, are higher than all the other members by approximately four inches to form a frame around the entire structure. The parallel channel members which form the support for the concrete studs include cavities of considerable volume which are eventually filled with concrete to encase the ends of the concrete studs which are set into the notches in the channels with the ends of the studs extending into the cavities.

Before concrete is poured into the assembly jig, sheet insulation is laid over the concrete studs and impaled upon fasteners cast into and protruding from the concrete studs, and wire reinforcing mesh is laid atop the sheet insulation, but the sheet insulation is sized so that it does not cover the cavities of the channel members.

The wall is then completed by pouring concrete into the jig so that it covers the insulation, the fasteners protruding through the insulation, and the wire mesh, and fills the cavities in the channel members. The concrete is poured to the height of the top of the outer frame members, and once hardened, not only forms an integral exterior surface, but also bonds together the studs, the insulation, and the top and bottom support beams which are formed in the channel members.

The prior art describes the final step of manufacture of the wall as lifting the hardened concrete wall from the assembly jig by jacking one edge of the wall out of the assembly jig, and then attaching lifting aids, such as eyebolts, to holes cast in the upper or lower concrete beams.

However, the task of removing the finished wall from the assembly jig disclosed in the prior art is much more difficult than one might suppose. There is a significant tendency for the wall to adhere to the jig and lock up within it. For example, concrete may leak through the edges of the notches cut in the channel members to support the studs, and such concrete, once hardened, prevents removal of the wall from the assembly jig.

Moreover, even slight irregularities in the sidewalls of the channel members also tend to lock the wall into the assembly jig. For instance, if a dent exists in the sidewall of a channel member, that dent will, depending upon the direction in which it protrudes, either be filled with or surrounded by hardened concrete. Under such circumstances, it is impossible to pull out the concrete beam formed within the channel member without chipping, or at least scoring, the concrete beam. Furthermore, even if the damage to the prefabricated concrete wall can be tolerated, the rigid channel members of the assembly jig of the prior art require much more force, more powerful equipment, and more disassembly time than is desirable to remove the finished wall from the assembly jig.

SUMMARY OF THE INVENTION

The present invention completely eliminates the problems associated with casting a prefabricated concrete wall using a reusable assembly jig. Use of the present invention permits the entire wall, including the concrete studs, to be formed with a single pouring of concrete. Moreover, the entire mold for the wall is formed of insulating foam which remains attached to the wall, so that the requirement of breaking the finished wall loose from an assembly jig is completely eliminated. When the concrete hardens, the entire assembly, including the attached foam which will serve as thermal insulation for the finished wall, is simply moved into storage or onto a truck.

A further advantage of the present invention is that, unlike prior art prefabricated concrete walls, the wall of the present invention has insulation completely covering the inside surfaces of the wall, including the surfaces of the concrete studs.

However, the most important advantage of the invention is the simplicity of the construction. No concrete studs need to be separately produced or moved to and set into an assembly jig before the concrete is poured, and top and bottom beams need not be used because reinforcing bars are cast into the face of the concrete wall to furnish strength at the top and bottom of the wall. The entire wall is formed in a single concrete pouring, and the simple, inexpensive insulation foam assembly jig becomes an integral part of the finished wall. This reduces both the time for and cost of producing the wall.

The single use assembly mold is formed on a horizontal surface using simple planar slabs of insulation foam. To create each stud form, a "U" shaped metal channel is set upon a flat horizontal surface with the open channel oriented upward. Two vertical slabs of insulation foam are then placed within the metal channel, separated by a beam of insulation foam at the bottom of the channel which holds the vertical slabs against the insides of the legs of the metal channel. In the preferred embodiment, the upper edges of the channel legs are bent slightly inward so that the edges actually dig into the slabs of foam which are forced against them. The foam slabs and foam beam are sized to extend for the entire dimension of what will later be the height of the wall, and the heights of the vertical slabs are chosen to match the dimension of the future depth of the stud. Thus, the bottom foam beam and the two vertical slabs of foam form a cavity which determines the size of the wall stud.

The tops of the vertical slabs of foam insulation are also used to support large sheets of insulation which determine the surface area of the finished wall. The sheets are supported between two stud cavities by forming ridges in the edges of either the sheets or the vertical cavity slabs, so that they interlock. Regardless of which part has a ridge cut into it, the interlocking fit prevents the tops of the stud cavity's vertical slabs from separating when concrete is poured into the cavity's insulation mold.

By using two insulating slabs and a insulating bottom beam to form each stud cavity and foam sheets to span the spaces between the stud cavities, an entire wall mold is formed except for the end configurations. The parts of the wall which are at the ends of the stud cavities are closed off by a channel shaped metal sill plate. This plate is held in place by screws driven through the sill plates side legs and into the metal channels on each stud cavity and into the insulation sheets atop the stud cavities. All that is then required is another foam end sheet covering the sections of the wall at the ends of the stud cavities, and such end sheets are easily attached by the use of screws driven through the end sheets into the edges of the insulation sheets and the insulation slabs.

The beauty of the simple insulation foam construction of the wall mold is that the foam is desirable to insulate the concrete wall, and once the concrete is poured and hardened there is no mold from which the concrete wall must be removed. The entire assembly, including the concrete and the insulation, is the finished product, which is a unitized concrete wall with the inside surfaces fully covered with insulation, and the metal channels are "nailer" strips which serve as lath to which interior finishing material can be attached to each stud.

Thus the present invention furnishes a prefabricated concrete wall and the process for constructing it which result in faster construction and better insulated walls.

DETAILED DESCRIPTION OF THE INVENTION

Figure 1:
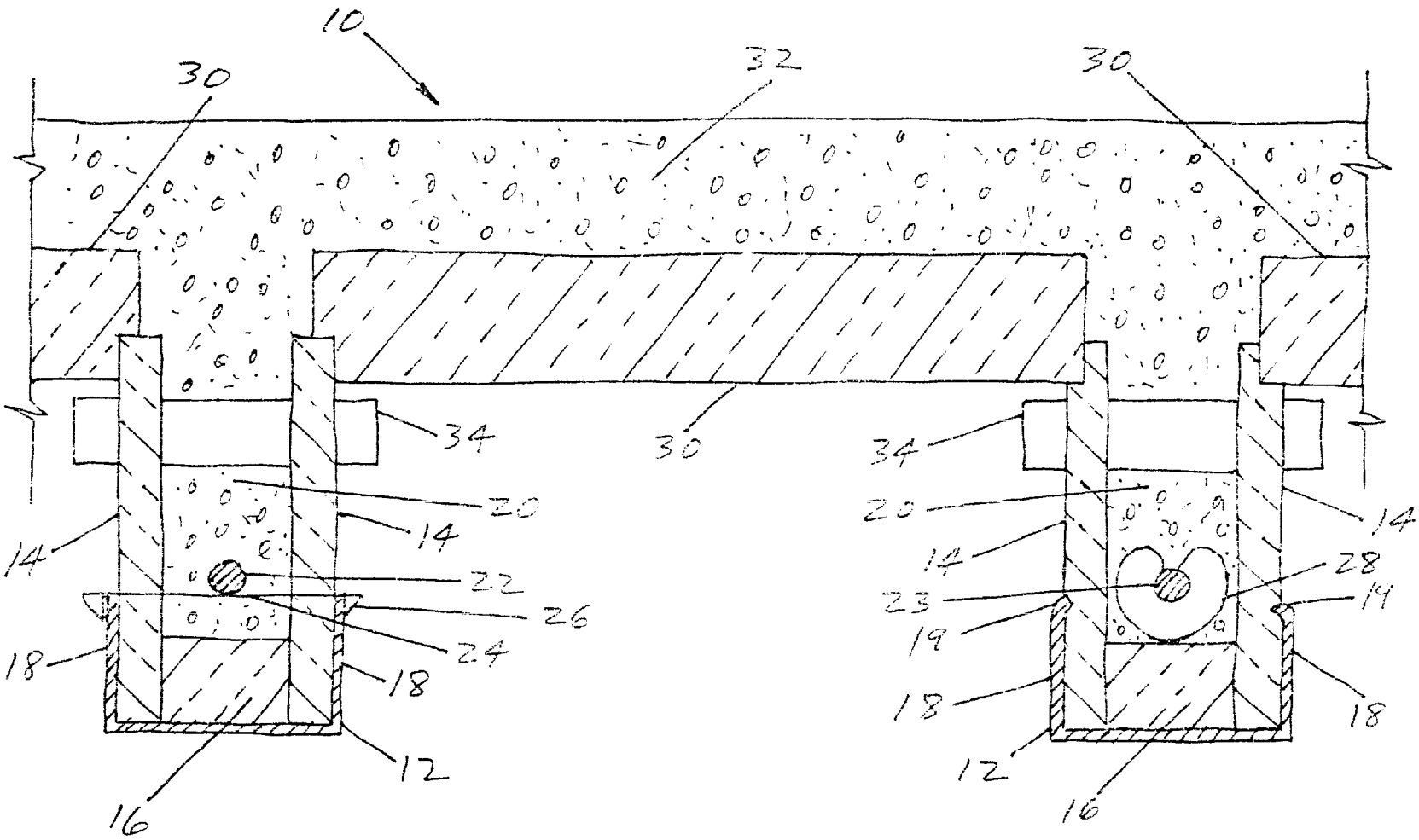
FIG. 1 is a cross section view of a middle portion of the finished wall panel of the preferred embodiment of the invention shown in the horizontal molding position.

FIG. 1 is a cross section view of a middle portion of finished wall panel 10 of the preferred embodiment of the invention shown in the horizontal molding position.

The mold into which concrete is poured to form wall panel 10 is formed completely of insulation foam, and a new mold is assembled for each wall panel manufactured. However, the assembly of the mold is so simple and the material is so inexpensive, that the cost of a wall panel constructed according to the present invention is actually less than the cost when using a reusable mold. That is largely because the insulation foam used to assemble the mold is required to be attached to the wall panel even when using a reusable mold, and the present invention eliminates the labor required to construct separate concrete studs and to separate the finished wall panel from the reusable mold.

The construction of wall panel 10 begins by placing metal channels 12 at the location of each future concrete stud with the open side of the channel facing upward. Metal channels 12 are typically spaced 24 inches apart, are as long as the ultimate height of wall panel 10, and may rest on any flat surface. Channels 12 serve two purposes. They hold the foam boundaries of the mold together to prevent separation by the hydraulic pressure of the unset concrete, and when the wall is complete and installed, channels 12 can be used as nailers to attach wall finishing materials.

Insulation foam slabs 14 and insulation foam beams 16 are then placed within each metal channel 12 to form cavities which will be filled with concrete to form studs 20. Slabs 14 are placed adjacent to vertical legs 18 of metal channels 12, and beams 16 are located at the bottom of channels 12 between slabs 14 to force slabs 14 against vertical legs 18. Both slabs 14 and beams 16 extend the entire length of metal channel 12 and the height of wall panel 10, while the heights of slabs 14 extend to at least the dimension which will be the width of wall studs 20. The widths of beams 16 determine the ultimate thickness of wall studs 20. In the preferred embodiment, as shown in FIG. 1 at the right stud, upper edges 19 of channel legs 18 are bent slightly inward so that edges 19 actually dig into slabs 14 which are forced against edges 19.

Reinforcing bars 22 and 23, commonly referred to as "rebars", are located within the cavities for studs 20 by conventional devices. One such device is shown on the left wall stud in FIG. 1. It is a simple wire 24 which spans the space between slabs 14, and can include bends 26 on the ends which both hold it in place and prevent legs 18 of channel 12 from separating. The other conventional holder for a rebar is pictured at the right wall stud. It is called a "saddle". Saddle 28 is a simple thin disc-like insulation shape which snaps around rebar 23 and rests upon foam beam 16. In the case of both wires 24 and saddles 28, several such devices are spaced along the length of the rebar to support its weight.

Plastic foam sheets 30 are held on top of foam slabs 14 to form the planar boundary onto which concrete sheet 32 of wall panel 10 is formed. In order to interlock foam sheets 30 with foam slabs 14 upon which foam sheets 30 rest, one or the other of the pieces has a ridge formed in its edge. The two variations are shown near the top of the right and left stud 20 in FIG. 1. At the left stud, the ridges are cut into the edges and bottoms of foam sheets 30, and foam slabs 14 fit into the undercut on sheets 30. At the right stud, ridges are cut into the sides and top edges of foam slabs 14, and foam sheets 30 fit into the cuts on slabs 14. In either configuration foam sheets 30 prevent foam slabs 14 from separating when concrete is poured into the cavity for stud 20.

In order to form holes in studs 20 for later use in passing pipes, wires, or other utilities through wall panel 10, fillers 34 are placed at various positions within the cavities which form studs 20. This is a simple matter of punching holes in foam slabs 14 and supporting either a foam block or a hollow pipe between two foam slabs 14.

Once fillers 34 are in place, concrete can be poured into the mold formed by foam sheets 30, foam slabs 14, and foam beams 16. A major benefit of the present invention is that all the concrete for entire wall panel 10 is poured at once, and the entire structure is formed as one integrated piece of concrete.

Typical dimensions of a finished wall panel 10 are 8 feet high by 8 feet long with studs 20 spaced 24 inches apart. Concrete sheet 32 is 1¾ inches thick while foam sheets 30 are 2 inches thick. Typically, foam slabs 14 and foam beams 16 are ¾ inch thick.

Figure 2:
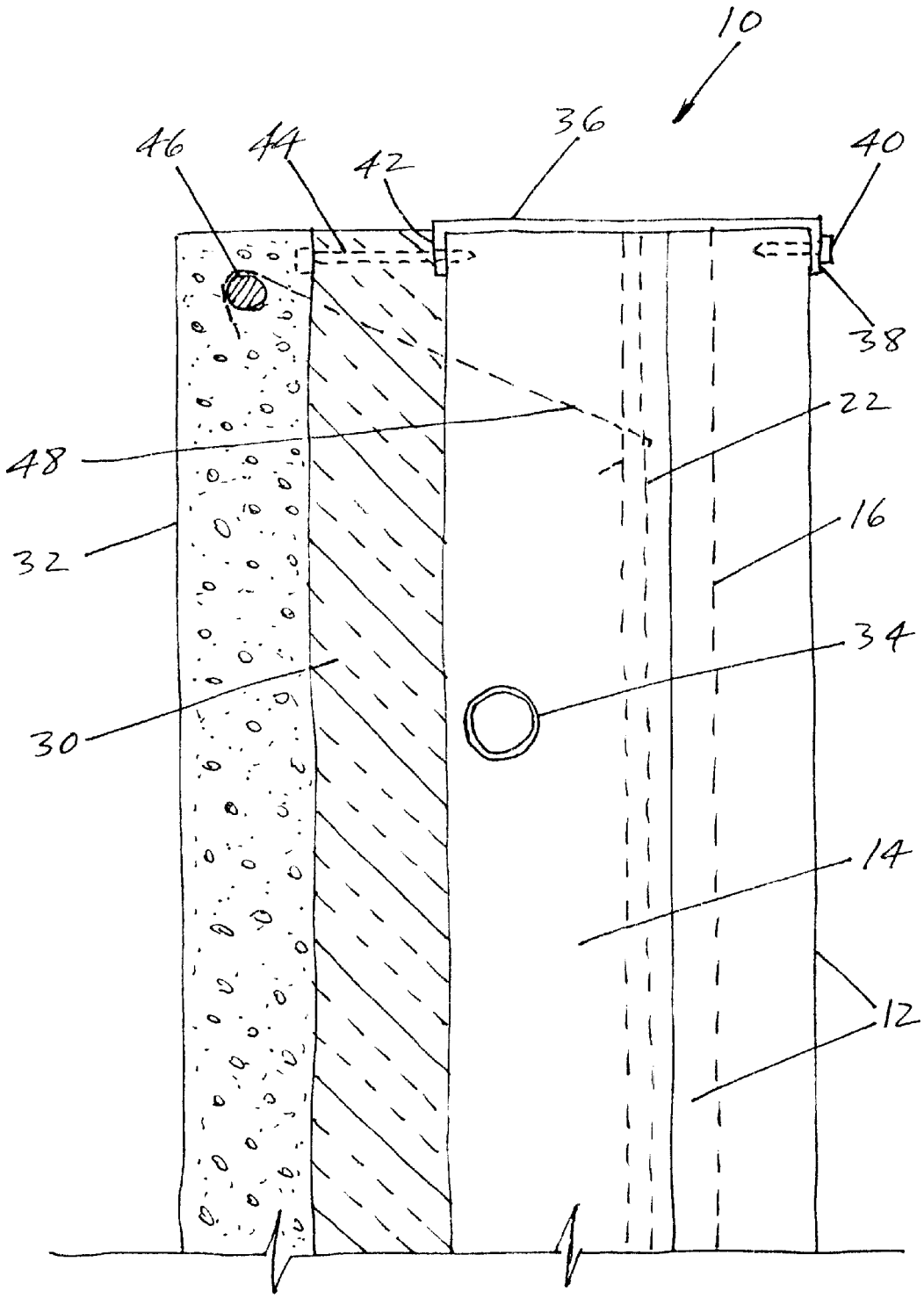
FIG. 2 is a partial cross section view of the end portion of the finished wall panel of the preferred embodiment shown in the vertical position in which it is used.

FIG. 2 is a partial cross section view of the end portion of finished wall panel 10 of the preferred embodiment shown in the vertical position in which it is ultimately used. As shown in FIG. 1, concrete sheet 32 is formed adjacent to foam sheet 30, and foam slab 14, which covers stud 20, is located on the side of foam sheet 30 opposite from concrete sheet 32. Metal channel 12 covers the end of foam slab 14.

FIG. 2 shows the configuration formed at the end of stud 20. At that location, a metal channel forms sill plate 36 to which other building structures, such as floor joists may be attached. Sill plate 36 is attached to wall panel 10 by attaching it to the foam mold before concrete is poured into the mold. One leg 38 of the channel of sill plate 36 is attached to metal channel 12 by fastener 40. The second leg 42 of sill plate 36 is set between foam sheet 30 and stud,20 by driving fastener 44 through foam sheet 30 and through sill plate leg 42 and into the cavity within which stud 20 will be formed. Thus, when the concrete is poured to form wall panel 10, sill plate 36 is locked firmly in place between metal channel 12 and concrete sheet 32 and concrete stud 20.

FIG. 2 also shows a desirable arrangement for installing reinforcing bars within concrete sheet 32 and integrating the reinforcing structure within wall panel 10. Reinforcing bar 46 is located within concrete sheet 32 by placing reinforcing bar 46 within the foam mold before the concrete is poured. The location of bar 46 is determined by the conventional methods previously discussed in regard to locating bars 22 and 23 of FIG. 1. However, it should be appreciated that, when wall panel 10 is installed in its usual position as a vertical wall, bar 46 is oriented in a horizontal plane while bars 22 and 23 of FIG. 1 are oriented in vertical planes.

It is then quite advantageous to strengthen wall panel 10 by tying together bar 46 and the reinforcing bars within all of the concrete studs, such as bars 22 and 23. This is done by the use of conventional shear connector 48. Shear connector 48 has loops at its ends which fit around bar 46 and bar 22. Since bar 46 extends throughout the entire horizontal width of wall panel 10 and is tied together with the bars in all of the vertical studs, it thereby integrates wall panel 10 with a network of reinforcing bars and shear connectors.

Figure 3:
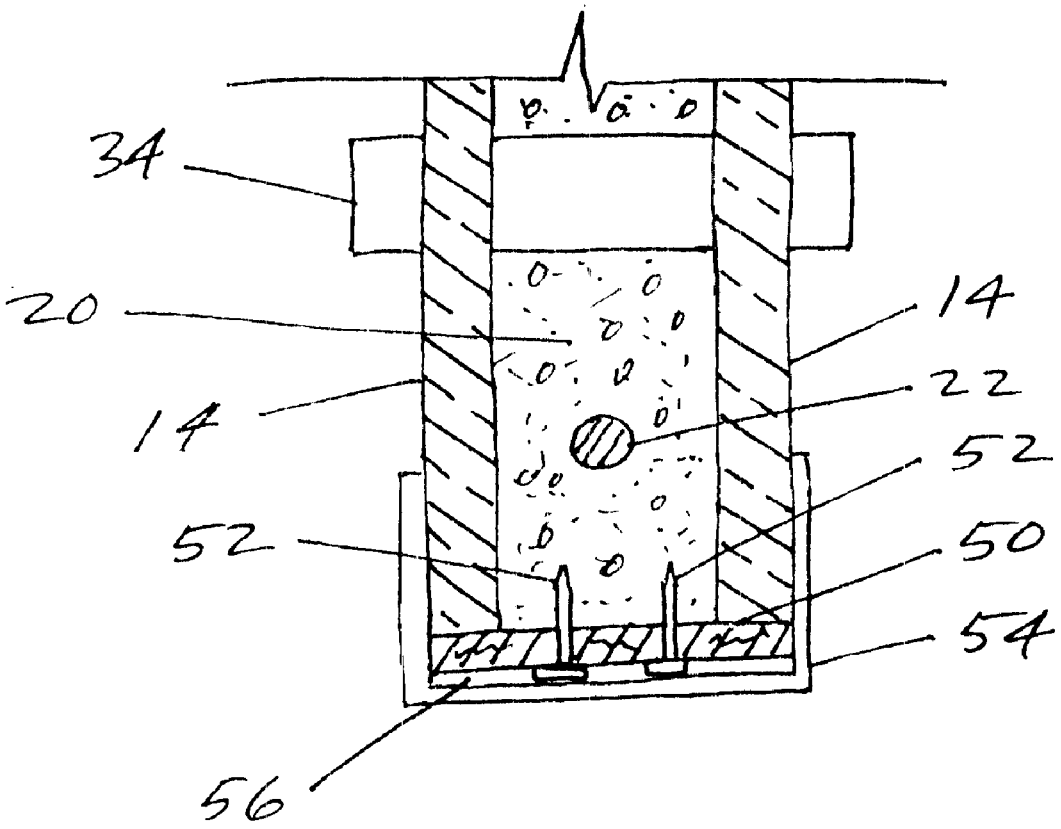
FIG. 3 is a cross section view of a portion of a stud which depicts an alternate embodiment of the invention in which the end surface of the stud is covered by wood lath to facilitate nailing to the stud.

FIG. 3 is a cross section view of a portion of a stud 20 which depicts an alternate embodiment of the invention in which the end surface of the stud is covered by wood lath 50 to facilitate nailing to the stud. To install lath 50 during the forming of the wall, nails 52 are installed on lath 50 and lath 50 is simply placed within channel 54 with the nails pointed upward to begin set up of the mold for pouring concrete. Nails 52 then hold lath 50 onto concrete beam 20 when the concrete is hardened. However, in this alternate embodiment, channel 54 is removed from the finished wall structure to expose lath 50. The removal of channel 54 is quite easy because there is no significant contact between channel 54 and lath 50 because of spacing 56 between them because of the heads of nails 52. It should also be appreciated that it is also possible to use plastic materials such as vinyl instead of wood for lath 50.

The present invention thereby provides a prefabricated reinforced concrete wall structure which is not only fully insulated but is also simple and less expensive to construct than prior prefabricated concrete walls.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed as new and for which Letters Patent of the United States are desired to be secured is:

1. A prefabricated concrete wall panel comprising:

a concrete sheet forming a first wall surface;

concrete studs formed with and protruding from a second surface of the concrete sheet so that each stud has two side surfaces and an end surface extending beyond the concrete sheet;

insulation sheets covering the second surface of the concrete sheet between the concrete studs;

individual insulation slabs covering each of the two side surfaces of each of the concrete studs and interlocking with the insulation sheets covering the second surface of the concrete sheet; and channels holding the insulation slabs covering the side surfaces of the studs in place.

2. The prefabricated concrete wall panel of claim 1 further including insulation on the end surfaces of the concrete studs.

3. The prefabricated concrete wall panel of claim 1 wherein the concrete studs are integrated with the concrete sheet.

4. The prefabricated concrete wall panel of claim 1 wherein the insulation sheets covering the second surface of the concrete sheet are foam.

5. The prefabricated concrete wall panel of claim 1 wherein the insulation covering the studs is foam.

6. The prefabricated concrete wall panel of claim 1 further including reinforcing bars located within the concrete sheet.

7. The prefabricated concrete wall panel of claim 1 further including reinforcing bars located within the concrete studs.

8. The prefabricated concrete wall panel of claim 1 further including at least one removable filler piece passing through a concrete stud.

9. The prefabricated concrete wall panel of claim 1 further including at least one pipe passing through a concrete stud.

10. The prefabricated concrete wall panel of claim 1 wherein the channels include legs with edges turned in toward each other so that the edges cut into the insulation slabs covering the two side surfaces of the concrete studs.

11. The prefabricated concrete wall panel of claim 1 further including a sill plate attached to at least one concrete stud.

12. A method of constructing a wall panel comprising:

placing channels with vertical legs at the location of each concrete stud to be produced, with the open side of the channel facing upward;

placing insulation within each channel to form stud cavities, with vertical insulation placed adjacent to the vertical legs of the channels and bottom insulation placed at the bottom of the channels between the vertical legs of the channels;

placing top insulation sheets on top of the vertical insulation in the channels to form a solid boundary between the stud cavities for holding unset concrete;

pounding concrete onto the insulation sheets and into the stud cavities; and permitting the concrete to harden to form a wall panel with a sheet of concrete formed with concrete studs and with insulation covering the studs and the surfaces between the studs.

13. The method of claim 12 further including forming ridges on the edges of the top insulation sheets so that the sheets interlock with the insulation in the channels upon which the sheets rest.

14. The method of claim 12 further including removing the channels from the structure after the concrete has hardened.

15. The method of claim 12 further including forming ridges on the edges on the vertical insulation within the channels so that the insulation within the channels interlocks with the top sheets which rest upon the insulation within the channels.

16. The method of claim 12 further including placing filler structures within the cavities to form openings through the studs by forming holes in the insulation within the cavities and supporting the filler structures between the holes in the insulation within the stud cavities.

17. The method of claim 12 further including locating reinforcing bars in the space within which the concrete sheet will be formed.

18. The method of claim 12 further including locating reinforcing bars in the stud cavities within which the concrete studs will be formed.

19. The method of claim 12 further including locating sill plates at the ends of stud cavities by attaching the sill plates to the channel and to the insulation sheet with fasteners.

* * * * *